US011344068B2

(12) United States Patent
Alyemni

(10) Patent No.: US 11,344,068 B2
(45) Date of Patent: May 31, 2022

(54) BANDLESS BRASSIERE

(71) Applicant: Kholood Jamal Alyemni, Fairfax, VA (US)

(72) Inventor: Kholood Jamal Alyemni, Fairfax, VA (US)

( * ) Notice: Subject to any disclaimer, the term of this patent is extended or adjusted under 35 U.S.C. 154(b) by 0 days.

(21) Appl. No.: 16/693,222

(22) Filed: Nov. 22, 2019

(65) Prior Publication Data

US 2021/0153571 A1 May 27, 2021

(51) Int. Cl.
*A41C 3/00* (2006.01)

(52) U.S. Cl.
CPC ..... *A41C 3/0007* (2013.01); *A41C 3/0028* (2013.01)

(58) Field of Classification Search
CPC .... A41C 3/0057; A41C 3/0007; A41C 3/0028
USPC ..... 450/81, 88, 86, 7
See application file for complete search history.

(56) References Cited

U.S. PATENT DOCUMENTS 2,475,624 A * 7/1949 Laszlo ..... A41C 3/0057 450/63
3,071,140 A * 1/1963 Adler ..... A41F 15/00 450/86
3,109,431 A 11/1963 Jefferson
3,276,449 A * 10/1966 Morgan ..... A41C 3/065 450/81
3,306,299 A * 2/1967 Paramore ..... A41C 3/0007 450/81
3,465,754 A * 9/1969 Lockwood ..... A41C 3/00 450/1
3,935,865 A 2/1976 Newmar
4,343,313 A * 8/1982 Le Jeune ..... A41C 3/065 450/39
4,418,696 A * 12/1983 Delet ..... A41C 3/0078 450/52
5,797,786 A * 8/1998 Smith ..... A41D 13/1245 2/67
5,983,393 A * 11/1999 Walton ..... A41C 3/0007 2/67
6,547,636 B1 * 4/2003 Cato ..... A41C 3/0028 450/86

(Continued)

FOREIGN PATENT DOCUMENTS

KR 200485000 Y1 12/2017

OTHER PUBLICATIONS

International Search Report related to international application No. PCT/US20/61888, dated Apr. 13, 2021, 2 pages.

*Primary Examiner* — Gloria M Hale
(74) *Attorney, Agent, or Firm* — Armstrong Teasdale LLP

(57) ABSTRACT

A brassiere includes a front piece including a first cup, a second cup, a first shoulder strap, and a second shoulder strap. The first shoulder strap has a first end connected to a top of the first cup and a second end connected to a bottom of the first cup or a bottom of the second cup. The second shoulder strap has a first end connected to a top of the second cup and a second end connected to the bottom of the second cup or the bottom of the first cup. The brassiere does not include a wing that extends from the first piece and wraps around the thoracic region of the wearer. The first shoulder strap and the second shoulder strap provide a downward tension and an upward force on the first cup and the second cup to secure breasts of a wearer in the first cup and the second cup.

20 Claims, 12 Drawing Sheets

(56) References Cited

U.S. PATENT DOCUMENTS

| | | | | |
|---|---|---|---|---|
| 6,896,582 | B2 * | 5/2005 | Kawami | A41C 3/06 450/64 |
| 10,524,519 | B2 * | 1/2020 | Deal | A41C 3/065 |
| 2010/0120329 | A1 * | 5/2010 | MacDonald | A41C 3/0021 450/40 |
| 2013/0237124 | A1 * | 9/2013 | Hall | A41C 3/00 450/38 |
| 2019/0008214 | A1 * | 1/2019 | Kaye | A41C 3/0028 |
| 2019/0029334 | A1 | 1/2019 | Wolff | |
| 2019/0174841 | A1 * | 6/2019 | Bastug | A41C 3/0007 |

* cited by examiner

BANDLESS BRASSIERE

BACKGROUND OF THE INVENTION

Women's underwear garments, such as Bras, Bralettes, Lingerie, casual bras and sports bras, etc. are garments used for breast support, positioning and comfort. The underwear garments are made with different materials and varying styles to accommodate a desired look and functionality. The garment types listed above generally comprise two breast cups or breast cup regions that may include underwire, a wing or waist band part, and straps connected to the top of the cup region and to the wing or waist band pieces of each side, along with support pieces for those three main parts. A wearer of such garment types consisting of those typical three main components have reported experiencing one or all of the following symptoms: neck, shoulder and back pain, headaches, and thoracic discomfort including but not limited to hunched back, curved back, caved in shoulder, shoulder pain, neck pain, nerve pinching, muscular and musculoskeletal pains. Other complaints include abdominal discomfort resulting in acid reflux, loss of appetite and general abdomen pain. Additionally, ill-fitted bras have been determined to cause breast tissue damage including but not limited to sagging of breast, stretch marks, breast tissue tear, and pain and discomfort of breasts. Wearers suffering from the physical localized and general pains have also reported emotional pains as a result. Such emotional discomforts include but are not limited to poor body image, low confidence, no self-love.

BRIEF SUMMARY OF THE INVENTION

Provided is a garment that is comprising of two connecting cups or cup regions, with top straps and bottom side straps that attach to the cups or cups regions. The top and bottom side straps replace the wing or waist band piece of the regular bra. With such a design the risk of pains and discomforts mentioned above are reduced or eliminated. The cups are positioned on the breasts comfortably as desired. The top straps are located and attached from the top region of the cup towards the shoulder, wrapping around the shoulder through the back strap, and the bottom side straps are located and attached from the bottom side region of the cups closer to the sides of the body.

The pull force of each strap works with the other strap creating the perfect tension. The top straps create an upwards pull uplifting the cup which uplifts the breast securing the breast in an upward manner, while the bottom side straps are creating a side downward pull positioning and securing the breasts in place. The semi opposite pulls of the straps—one being an upward pull and the other being a side downward pull—result in the perfect tension to secure the breasts up and in place. While distributing the breast weight and strap tension evenly across the back and shoulder without a wing or waist band to wrap around and squeeze the thoracic area and securing the breasts in place will result in reducing or eliminating symptoms of thoracic discomfort including but not limited to: acid reflux, loss of appetite, excess burping, gasses in the stomach, or even possible shifting of internal organs. Additionally, embodiments of the brassiere reduce the possibility of breast tissue damage including but not limited to sagging of breast, stretch marks, breast tissue tear, pain and discomfort of the breasts. In addition, embodiments of the brassiere reduce back and shoulder pains including but not limited to lower back pain, hunched back, curved back, caved in shoulder, shoulder pain, neck pain, nerve pinching, muscular and musculoskeletal pains. Wearers of previous brassieres suffering from the physical localized and general pains have also reported emotional pains as a result. Such emotional discomforts are including but not limited to poor body image, low confidence, or no self-love.

Further objects, features, parts, components, attachments, advantages and properties of said garment according to the present application will become apparent from the detailed description.

BRIEF DESCRIPTION OF THE SEVERAL VIEWS OF THE DRAWINGS

The disclosure will be explained in more detailed with reference to the example embodiments shown in the drawings, in which.

DETAILED DESCRIPTION OF THE INVENTION

Figure 1:
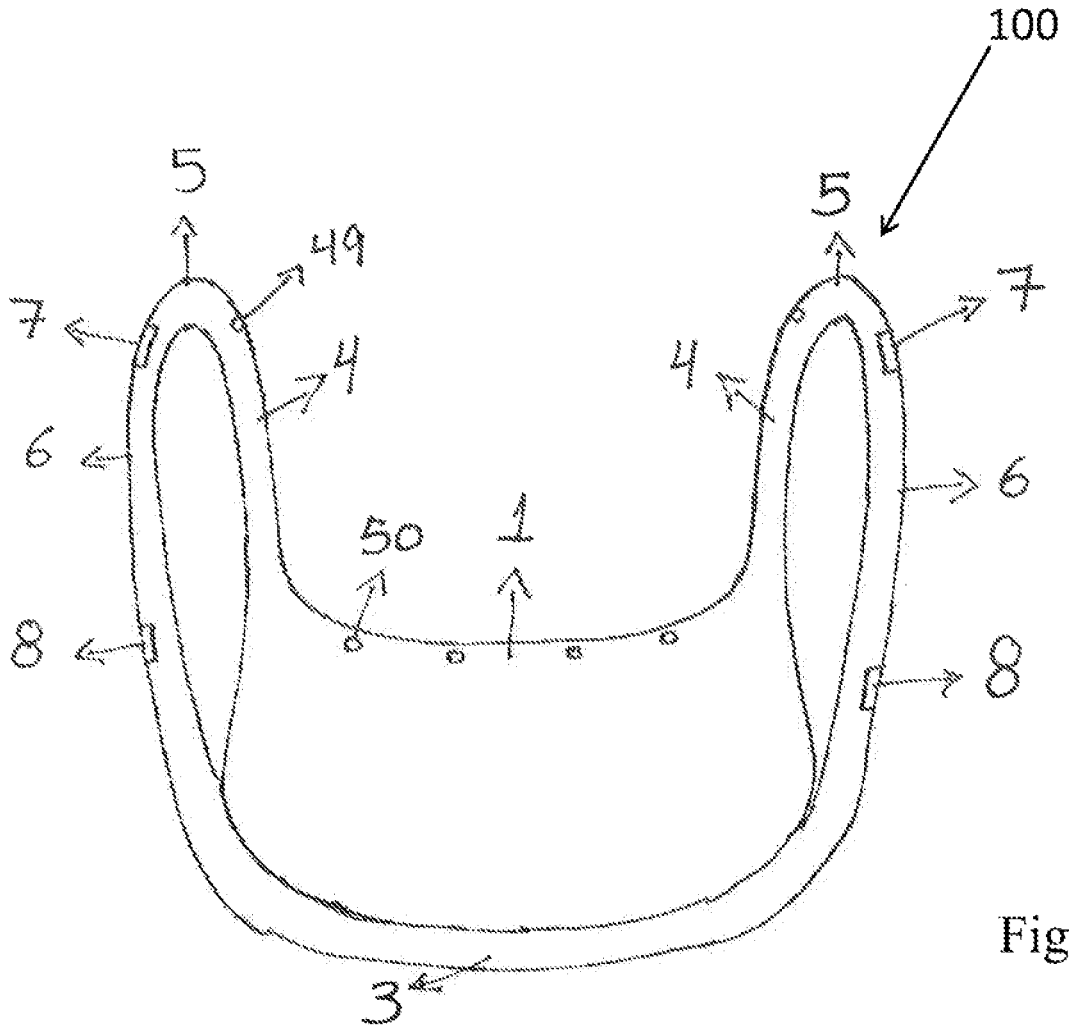
FIG. 1 is a front view of an exemplary embodiment of a brassiere including a lower edge and an upper edge, the lower edge and the upper edge each having a U-shape.

In the following detailed description, the advice according to the teaching for this application in the form of a bra will be described by the embodiments. It should be noted that although a bra with a few styles and designs is described, the teachings of this application can also be used in any other style or design in combination of the bra and all similar styles and designed garments and items of clothing hosting the same region.

The described bra is a bra without a band or wing piece which wraps around the waistline of a wearer under the breast to position the bra. The bra comprises two cups that are attached together or could be attached together from one side at, for example, a midpoint which would be along the sternum line of the wearer. There are two main base straps that connect to two different sides of the bra. The first end of the strap is to be attached or is attached to the top part of the cup, and the second end of said strap is to be attached or is attached to the bottom side (opposite of said midpoint) of said cup or the opposite cup. The second main strap is likewise attached to the other side of the bra. The two main straps are to act as and replace the waist band or wing piece of the typical bra. The main straps pull in semi opposite directions from the cups and secure and position the cups. As a result, the breasts are secured and positioned in their desired or natural place by the brassiere. The first end of the strap that is connected to the top side of the cup will pull and create an upward force and tension, pulling said cup in an upward manner. The second end of that strap is connected to the bottom side of said cup or opposite cup away from the midpoint/sternum line. Said end of the strap will create a downwards and side force and tension acting in a semi opposite direction of the first end of said strap. Accordingly, both ends of the straps will pull on each cup and create the perfect tension for the cups to be secured in the desired upwards position or other desired position. With said straps pulling in semi-opposite directions, the weight of the breast will be lifted and carried perfectly and the weight of the breasts will be distributed along the back and shoulders.

The described brassiere measurements may be slightly different than the typical bra. The cup size may be the same as typical bras. However, the length of the main straps may be based on a measurement of the wearer. The length of the main strap will begin from the midpoint which is along the sternum midline of the body, moving under the breast tissue to the back and climbing upwards to the shoulder and coming down to meet the top of the cup or coming down to go under the breast tissue to finish at the midpoint which is the sternum line which was the beginning point of measurements. The measurement may be in inches or centimeters. The measurements may be charted and listed according to the size, and then paired with the cup size. Based on the length of the straps and the cup size of a wearer, the full size of the brassiere would then be determined and designed to provide the brassiere that is perfectly fitted size for their body. The material of the brassiere may depend on the style of the brassiere. Some embodiments of the brassiere, for example, are fabric. There are different variation of styles of brassiere. The brassiere may contain underwire or may not contain an underwire, may contain extra padded cups for "Push up" style or may not contain extra padded cups, may contain memory foam or regular padding for the cups, full cups or low cut cups and all other variations of cups styles. It all depends on the desire and choice of the wearer. As for the main straps the material may vary as well as the style, thickness and whether they are padded or not padded and what type of padding. As for the attachment sites, the brassiere will have multiple attachment sites. These attachment sites may vary in their form of attachment, meaning they may contain hooks and eyes, and/or hook and loop fasteners and/or snaps and or buckle type attachments. The brassiere may contain one of a combination of all variations of cups style and design, straps styles and designs, and the attachment site styles and designs.

The brassiere has multiple styles. One of the styles is the "XX" style brassiere 1400 shown in FIG. 14. For example, the "XX-Bra" has attached two main straps and may be worn as one piece. The XX-Bra can have the straps already attached to the cups regions or the straps can be attached upon application of said bra. Additional support straps may be added as need to provide a desired style and or support for the brassiere. Then the wearer may adjust and position the bra in place and tighten the straps as desired. However, the straps are crossed in the back giving a different style and support and weight distribution of the breasts along the back and shoulders.

Figure 15:
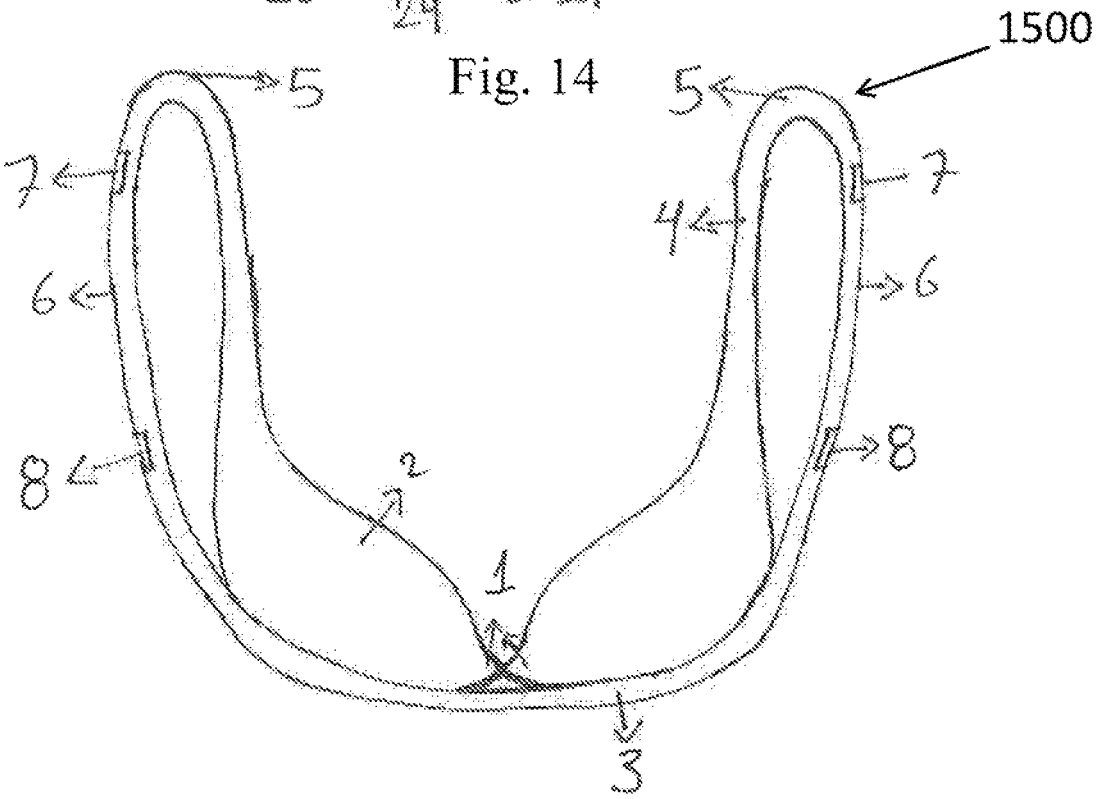
FIG. 15 is a front view of another embodiment of a brassiere, the brassiere including a lower edge having a U-shape and a bridge forming a crisscross pattern.
Figure 16:
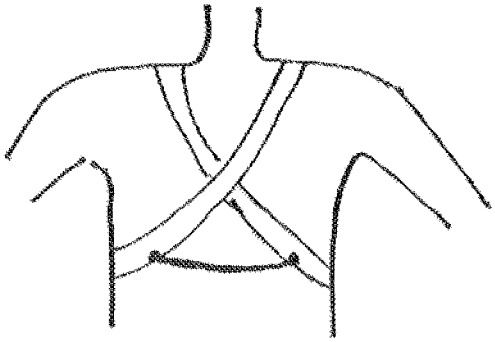
FIG. 16 is a rear view of the brassiere shown in FIG. 1, the brassiere worn by a person, the brassiere including shoulder straps that are positioned in a crisscross pattern and a removable support strap that is positioned on a lower portion of the brassiere.

A XU-style brassiere 1500 is shown in FIG. 15 and has attached two main straps. The bra 1500 may be worn as a one piece with straps attached before donning or the straps may be attached after positioning said cups in the appropriate place. The bra 1500 includes straps attached at the bottom of the cups and to the attachment piece 3. Additional support straps may be added as needed to style and or support. Then the bra is adjusted and positioned in place and the straps are tightened as desired. However, the straps extend along the sides of the back and the side to the cup region. Accordingly, the bra 1500 provides a different style and support and weight distribution of the breasts along the back and shoulders.

Figure 20:
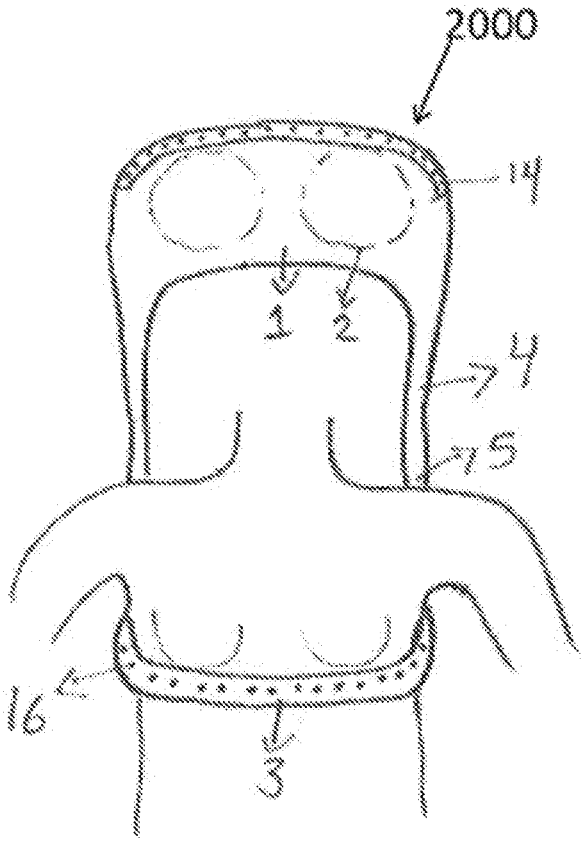
FIG. 20 is an illustration of a first step of donning an embodiment of a U-shaped brassiere.
Figure 21:
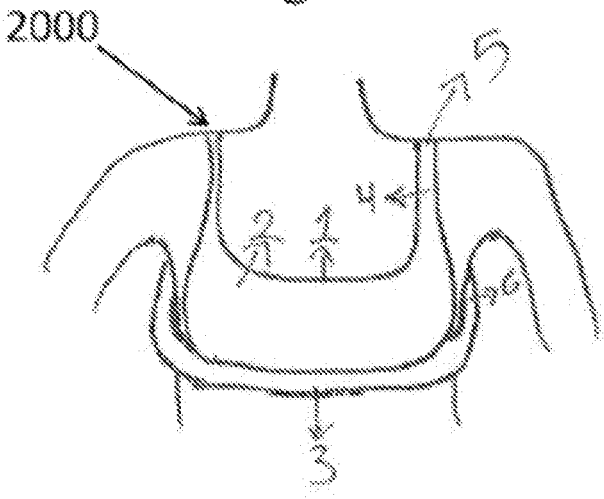
FIG. 21 is an illustration of a second step of donning the brassiere shown in FIG. 20.
Figure 22:
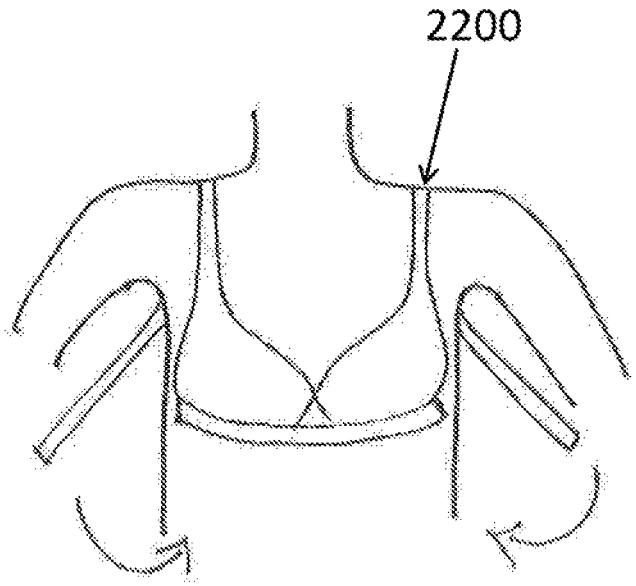
FIG. 22 is an illustration of a person donning an alternative embodiment of a brassiere including side straps that attach to a front main piece of the brassiere, the straps detached from the front main piece.
Figure 23:
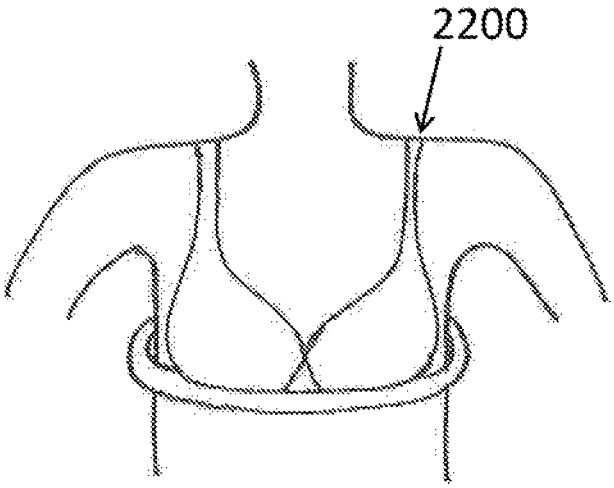
FIG. 23 is an illustration of a person donning the brassiere shown in FIG. 22, the side straps attached to the front main piece.
Figure 24:
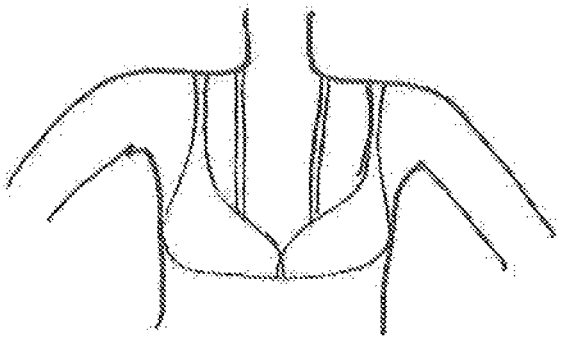
FIG. 24 is a front view of an alternative embodiment of a brassiere with removable support straps attached to cups of the bra, the brassiere being worn by a person with the removable straps positioned over the person's shoulders proximate the person's neck.
Figure 25:
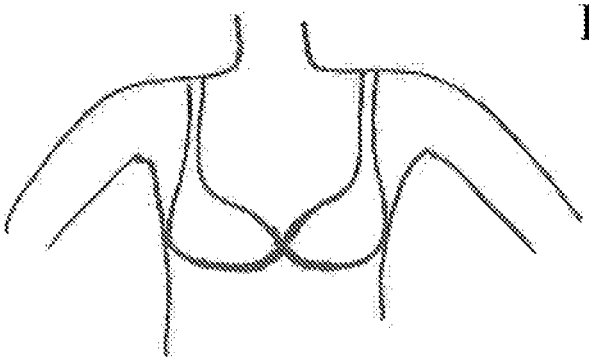
FIG. 25 is a front view of another embodiment of a brassiere, the brassiere being worn by a person, the brassiere including support edges that form a crisscross pattern at a front of the brassiere.
Figure 26:
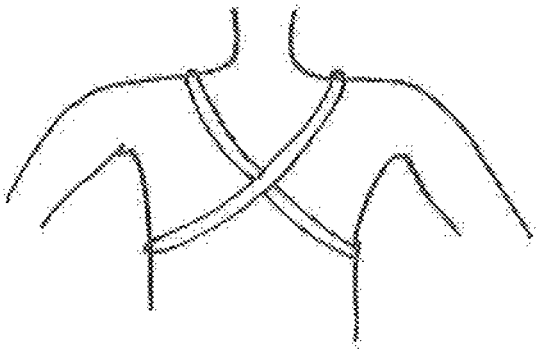
FIG. 26 is a rear view of yet another embodiment of a brassiere, the brassiere worn by a person, the brassiere having shoulder straps positioned in a crisscross pattern on a back of the wearer.

Another embodiment is a "U" style bra 2000, where the straps and the cups are one complete piece, as shown in FIG. 20, and FIG. 21. To don the bra 2000, first the piece 3 may be positioned under the breast tissue, and the arms of the wearer are brought through the sides so now the main piece is over the shoulder and the wearer's head may be brought back to the front. The wearer positions and places their breasts in cups. The attachment piece 14 is attached to the support piece 3 using whatever attachment method is chosen on the bra. The bra 2000 provides a different style and support and weight distribution of the breasts along the back and shoulders. [0049] In other embodiments, the front cup piece may vary and the main straps are attached from one end and free to be attached from the other. For example, FIGS. 22 and 23 show a brassiere 2200. To don the brassiere 2200, the cups and main piece are positioned on the breasts and said straps extend from the back of the wearer toward the front. The straps may, cross or drop down along the sides to come around once more to be attached to cup region. In the embodiment shown in FIG. 23, the straps come around the back and attach to the main piece in the bottom on the cup region.

Figure 36:
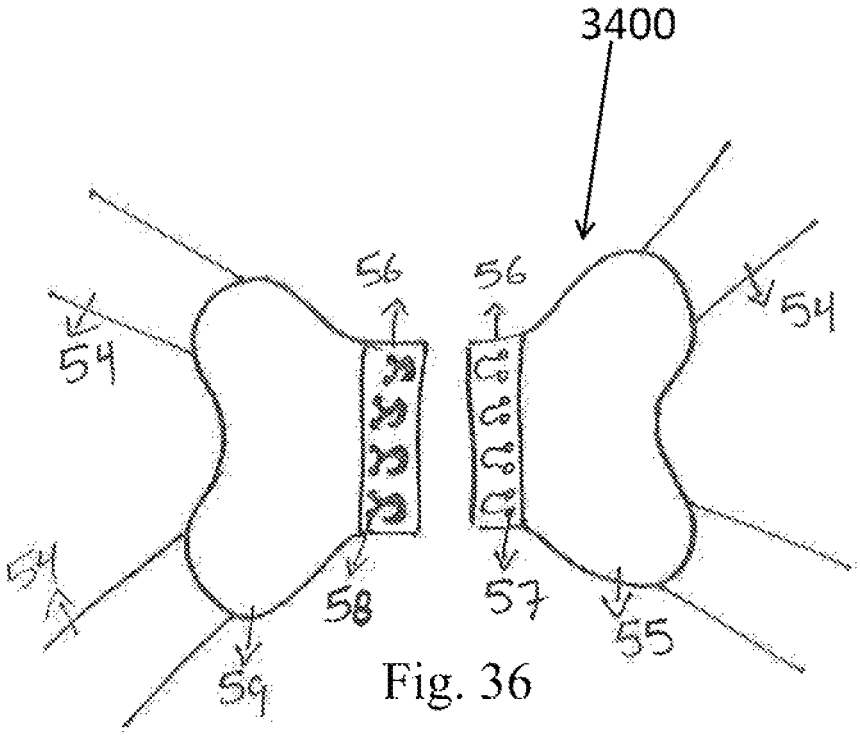
FIG. 36 is an enlarged view of the connector shown in FIG. 34 secured to the brassiere shown in FIG. 1, and illustrating engagement features on the connector.
Figure 34:
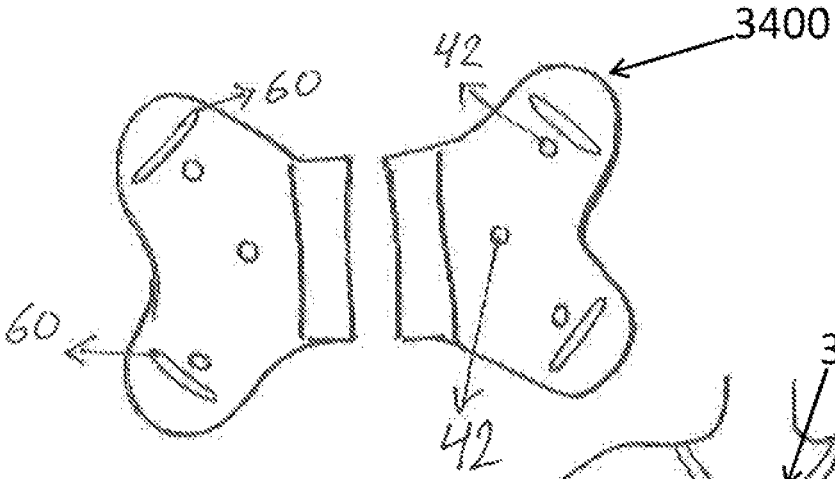
FIG. 34 is a front view of a connector for use with the brassiere shown in FIG. 1, the connector configured to couple straps of the brassiere.
Figure 35:
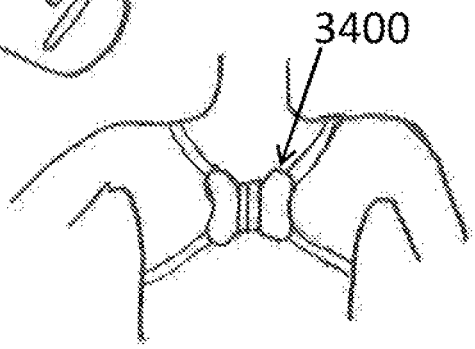
FIG. 35 is an illustration of the connector being used to couple first and second shoulder straps of the brassiere shown in FIG. 1, the brassiere worn by a person, the connector positioned on a back of the person.

In some embodiments, the bra has a straps connecter 3400 that may be placed along the straps. For example, as shown in FIGS. 34-36, the connector 3400 is two pieces 55, 59 that may be connected together. The attachment means 56 of the two pieces 55, 59 may be hook and loop fasteners, hooks 58 and eyes 57, or any suitable fasteners. One side 59 of the connector 3400 may be secured to the first strap 54 by threading the strap through slots 60 or using snaps and holes 42 and the other side of the connector 55 may be secured to the second strap 54. The straps are attached to the cup region of the bra and the straps connector 3400 may be connected to the straps to adjust the style and tension of the straps and the design and support of the bra.

The bra may have additional straps for support, style and design. FIGS. 8-11 and 27-33 show embodiments of different straps and securement mechanisms for straps. Additional straps may vary in size and function. For example, additional strap 10 (shown in FIG. 8) is thicker than other straps and can act as a major additional strap. Straps 6 and 51 can act as minor additional straps. Straps 6 and 51 are arranged to provide different support and design styles. Engagement device 52 in FIG. 28 is a hole arranged to receive, for example, snaps 43. In some embodiments, the straps include clips or hook and loop fasteners. In the illustrated embodiment, the straps may be secured with a zip tie 25 to secure the strap and provide the desired tightness and position of the strap. In other embodiments, the engagement device can be different from the method described. For example, the strap may be secured using an attachment site on the additional strap. These major and minor additional straps may be placed anywhere on the bra to achieve a desired style and/or provide extra support as desired for the needs of the wearer.

Figure 2:
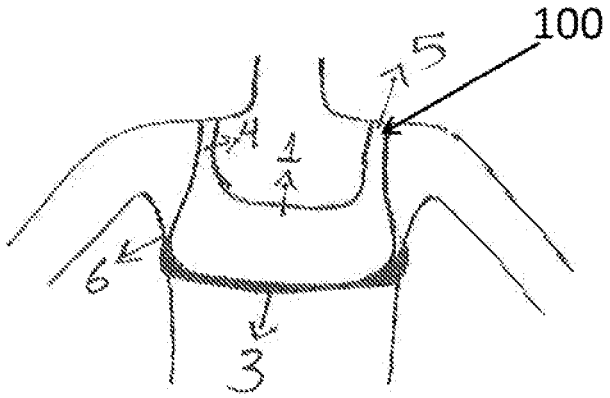
FIG. 2 is a front view of the brassiere shown in FIG. 1, the brassiere worn on a body of a person.
Figure 3:
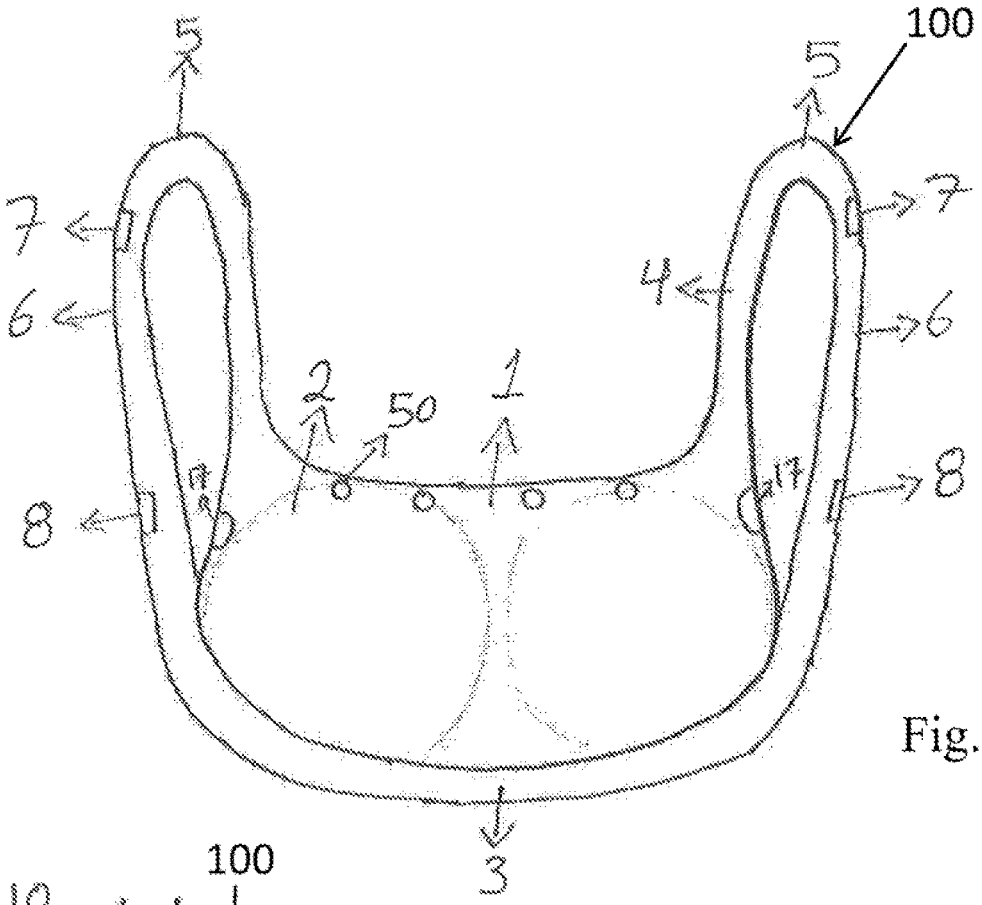
FIG. 3 is a rear view of the brassiere shown in FIG. 1, illustrating an interior side of the brassiere that is positioned against skin when worn on the body shown in FIG. 2.
Figure 12:
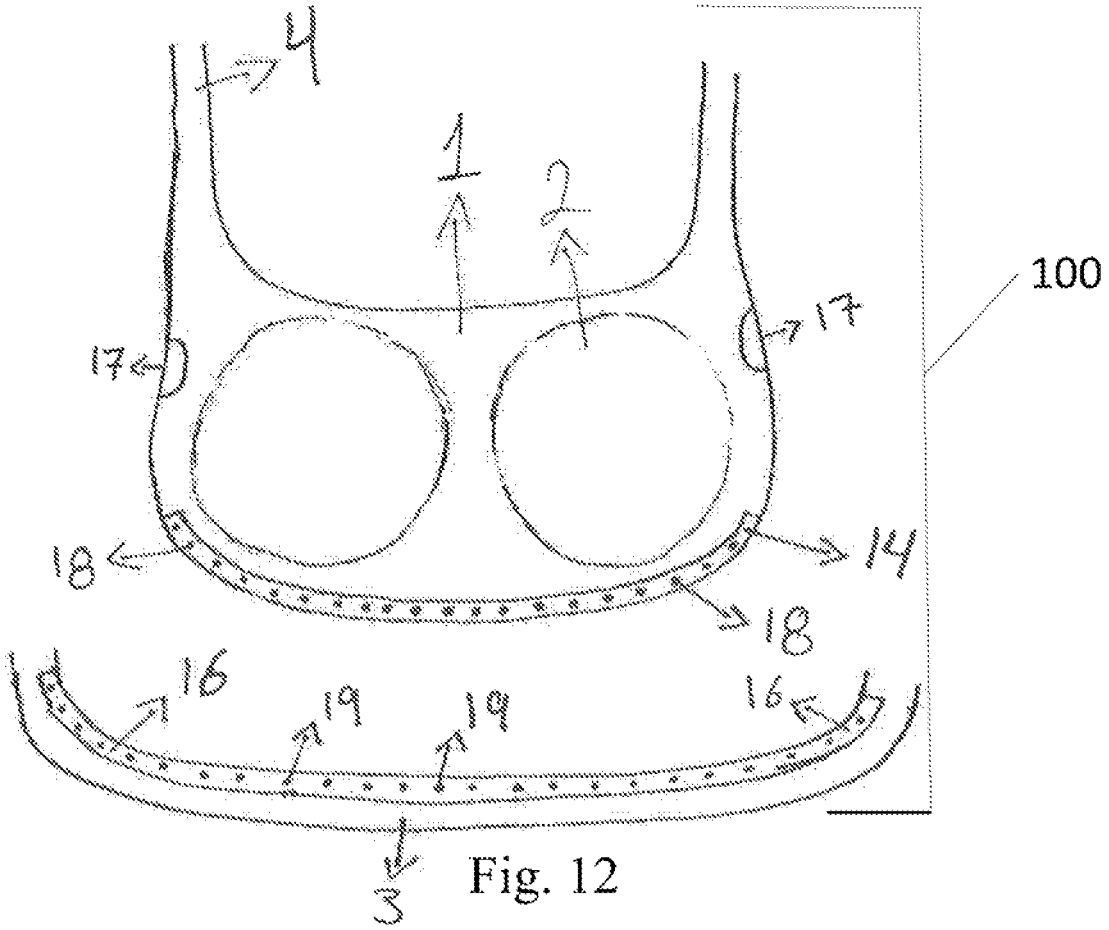
FIG. 12 is a rear partially exploded view of a portion of the brassiere shown in FIG. 1, illustrating an attachment site at the bottom of the brassiere, the brassiere including cups that are detached from a support at the attachment site.

In one example, shown in FIGS. 1-3, a bra 100 includes a main front piece 1 holding cups 2 of the bra 100. The front main piece 1 may be made from fabric. As shown in FIG. 12, the front main piece 1 includes a piece 14 forming an attachment site extending along the bottom of piece 1. The piece 14 includes hooks 18.

The cups 2 of the bra may be a desired size ranging from cups size A to G, for example. The cups 2 are secured and padded for comfort and strength. The front piece 1 may include under wire for the bra or may not, depending on the preference.

The bra 100 includes a piece 3 that connects the back straps (6) together and attaches to the attachment piece 1 using the eyes 19. As seen in FIG. 1, the piece 3 extends under the cups 2 along the bottom of the attachment piece 1.

Front straps 4 hold the main piece 1 up to provide the breasts the perfect lift.

In the example, shoulder pieces 5 of the straps 4, 6 are padded for comfort and less pressure on the shoulders.

Back straps 6 of the bra may have sections 7, 8 that act as the attachment station of the back straps for receiving the additional optional straps 10. The straps 10 may be attached to the front piece, the shoulder straps, or other removable straps 10. The straps 10 may be secured using the hook and loop fasteners or the hooks and eyes.

For example, a top attachment site 7 is disposed on the straps 6 right below the shoulders.

A bottom attachment site 8 is disposed on the straps near the sides of the body.

Figure 10:
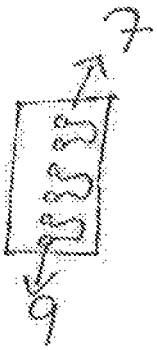
FIG. 10 is an enlarged rear view of a portion of the brassiere shown in FIGS. 1 and 4 illustrating a first attachment section of the brassiere.

Referring to FIG. 10, the straps may be secured using eyes 9 on the attachment site 7.

Figure 4:
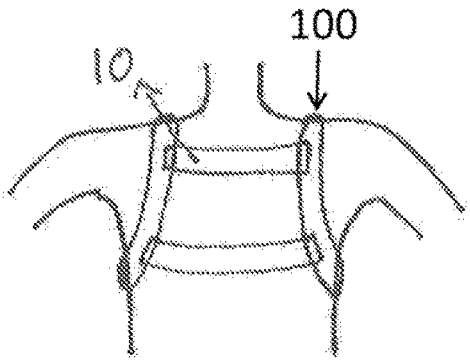
FIG. 4 is a rear view of the brassiere shown in FIG. 1, the brassiere worn by a person and including removable support straps that are positioned in a straight across style.
Figure 6:
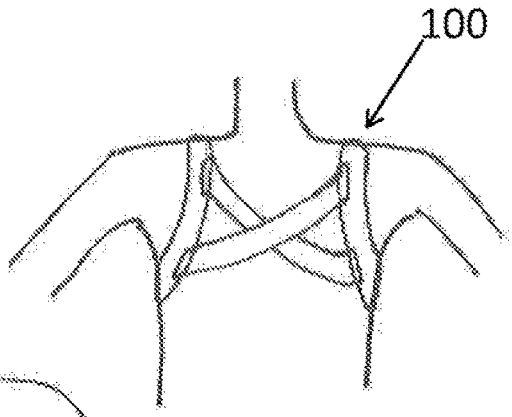
FIG. 6 is a rear view of the brassiere shown in FIG. 1, the brassiere worn by a person and including the removable support straps shown in FIG. 4 positioned in a crisscross pattern.
Figure 5:
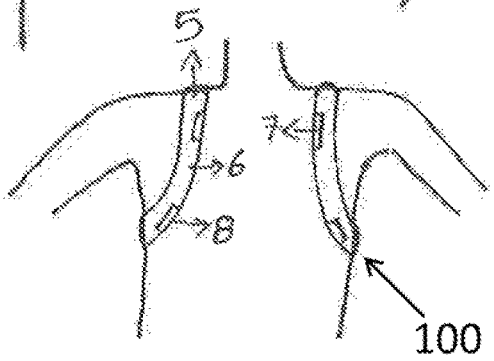
FIG. 5 is a rear view of the brassiere shown in FIG. 1, the brassiere worn by a person without the removable support straps shown in FIG. 4.
Figure 7:
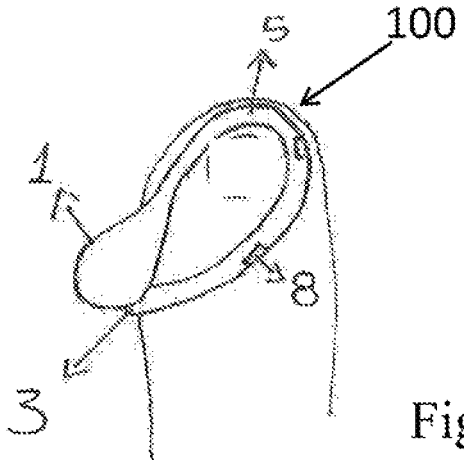
FIG. 7 is a side view of the brassiere shown in FIG. 1, the brassiere worn on a body of a person, a portion of the body is omitted to illustrate the side of the brassiere.
Figure 8:
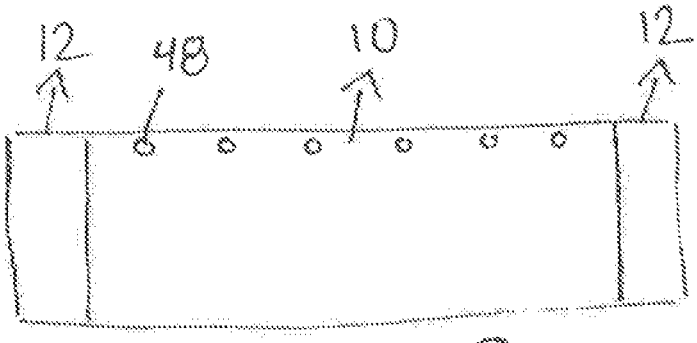
FIG. 8 is a front view of one of the removable support straps of the brassiere shown in FIGS. 1 and 4.

Referring to FIGS. 4, 6, and 8, an additional/optional back strap 10 may be secured in upper or lower back positions. The straps 10 may be secured in straight across patterns or crossed patterns making an X shape. The straps 10 may be attached to sites 7,8.

Figure 9:
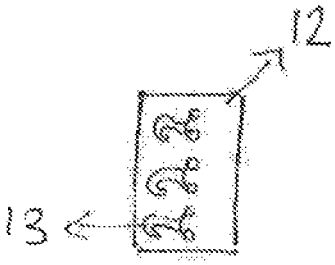
FIG. 9 is an enlarged rear view of a portion of the removable support strap shown in FIG. 8 illustrating attachment devices.
Figure 11:
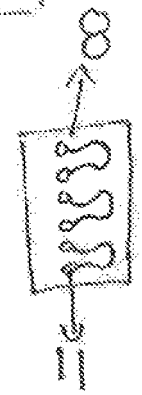
FIG. 11 is an enlarged rear view of a portion of the brassiere shown in FIGS. 1 and 4 illustrating a second attachment section of the brassiere.

As shown in FIG. 11, the straps 10 may be secured using eyes 11 on attachment site 8. For example, as illustrated in FIGS. 8 and 9, the straps 10 may include attachment sites 12.

The attachment sites 12 may include hooks 13.

Figure 13:
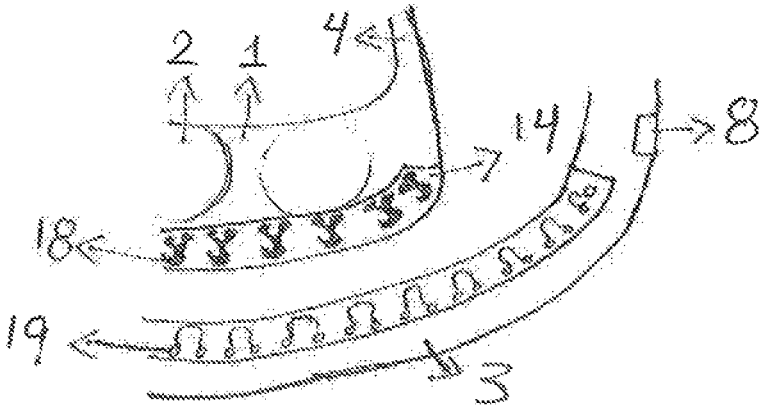
FIG. 13 is an enlarged view of a portion of the brassiere shown in FIGS. 1 and 12, illustrating attachment devices configured to removably secure the cups to the support, the attachment devices are in an unattached position.

Referring to FIGS. 12 and 13, the piece 3 may be secured to an attachment site 14 on piece 1. The piece 3 includes attachment site 16.

The cups 2 include attachment sites 17 on the sides of the cups.

The attachment site 14 includes hooks 18.

The attachment site 16 includes eyes 19.

Figure 14:
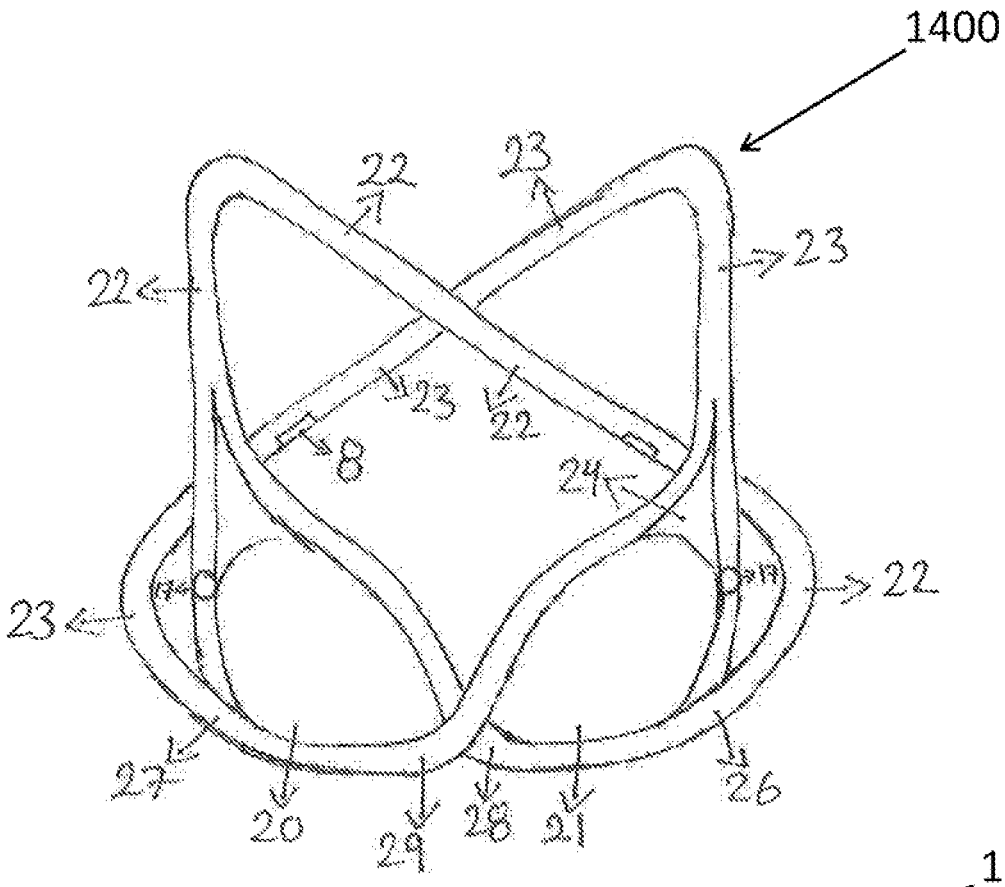
FIG. 14 is a front view of an alternative embodiment of a brassiere, the brassiere including a support system with straps forming a crisscross pattern on the front and back of the brassiere.

In another example, shown in FIG. 14, a bra 1400 is in the form of an XX-style bra. The bra 1400 includes a right cup 20, a left cup 21, a right strap 22, and a left strap 23. The right strap 22 wraps across the back of a wearer, around a side of the wearer, and secures to the bottom of the left cup. The right strap 22 is secured to the cup by a piece 26. The left strap 23 wraps across the back of the wearer, around a side of the wearer and secures to the bottom of the right cup. The left strap 23 is secured to the cup by a piece 27.

A space 24 is defined between the cup and the straps and may contain fabric or no fabric depending on style preferences.

A zip tie piece 25 (shown in FIG. 29) may be used to secure the straps 22, 23.

The right strap 22 connects to the bottom of the left cup 21 by piece 26.

The left straps 23 connect to the bottom of the right cup 20 at site 27.

A first end of the right strap 22 is joined to piece 26. Piece 26 extends along the cup 21 and then is joined to bridge portion 28. The bridge portion 28 is in the middle of the bra between cups 20, 21. The strap 22 extends upwards along the cup 20 from the other end of the bridge portion 29.

An end of strap 23 is joined to piece 27. The piece 27 extends along the cup 21 and is joined to a bridge portion 29. The bridge portion 29 is in the middle of the bra between cups 20, 21, and crosses bridge portion 28 as the bridge portion 29 extends upwards along the cup 21. The end of the bridge portion 29 is joined to the strap 23.

FIGS. 17-20, and 27-36 show embodiments of securement or attachment devices for use with the bras described herein.

Figure 17:
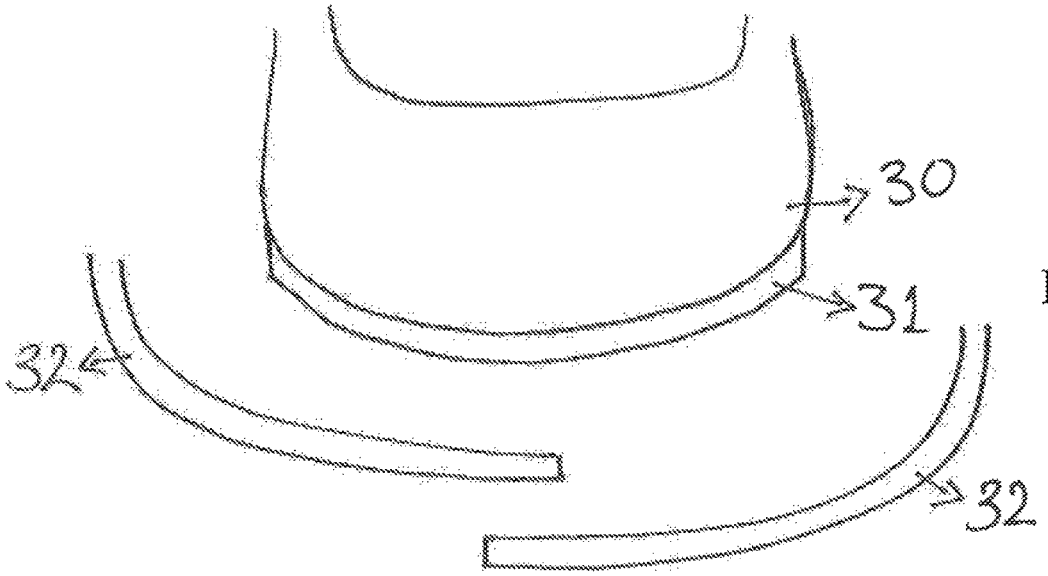
FIG. 17 is an exploded front view of a portion of the brassiere shown in FIG. 1, and illustrating a frontal main attachment piece of the brassiere, the frontal main attachment piece is detached from support pieces.
Figure 18:
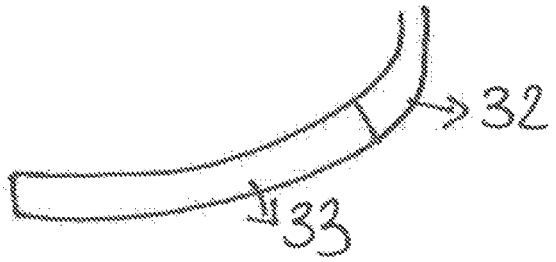
FIG. 18 is an enlarged view of a portion of the frontal main attachment piece of the brassiere shown in FIG. 1, the attachment piece in an open position.
Figure 18:
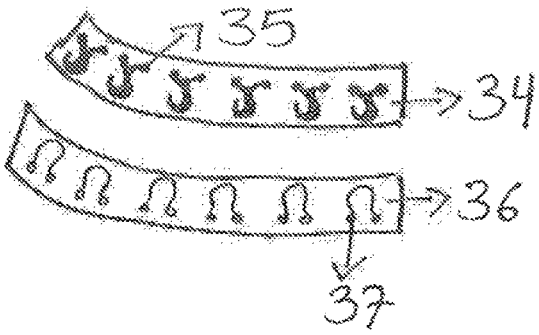
Figure 19A:
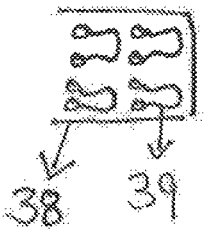
FIGS. 19A and 19B are enlarged views of a portion of attachment pieces of the brassiere shown in FIG. 17, the attachment pieces are detached from each other.
Figure 19B:
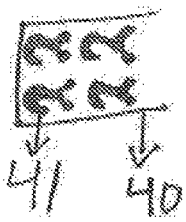

Referring to FIG. 17, an example frontal piece 30 is arranged to hold cups in place. The frontal piece 30 includes an attachment site 31 that connects with straps 32. For example, the straps 32 may be secured to the attachment site 31 by hook and loop fasteners. The straps 32 may include engagement devices 33 such as hooks or loops to attach to attachment site 31 on the bottom of piece 30. Attachment sites 34, 36 are examples of attachment sites for securing the pieces 32 to the piece 30. The site 34 includes hooks 35. The site 36 includes eyes 37. The eyes 37 receive the hooks 35 to secure the attachment sites 34, 36 together. In other embodiments, the attachment sites 34, 36 can include hook and loop fasteners.

Attachment site 38 is an example attachment site on the main frontal piece 30 that hold the cups. The attachment site 38 includes eyes 39 to connect to straps 40.

The attachable straps 40 include hooks 41 on the end of the straps to connect to the main frontal piece 30 that holds the cups.

Referring to FIGS. 27-33, the straps 6, for example, may be secured in position using various securement means. For example, the straps 6 may be secured using an arrangement of snap mechanisms. The straps 6 or other parts of the bra include holes 42 that receive snap mechanisms. The snap mechanisms include a male part 43 and a female part 44. The female and male parts of the snaps include holes 45. The male part further comprises a protruding part 46 that is received in a hole 47 in the female part 44 of the snap. The protruding part 46 goes into the hole 47 to lock the male and female parts in place. The female and male parts of the snaps may be connected by a string 53.

In some embodiments, the snap mechanisms are arranged for use with holes 48 in the strap 10 (shown in FIG. 8), holes 49 in the straps 6, or holes 50 in the front main piece 1 (shown in FIG. 1) above the cups.

Figure 27:
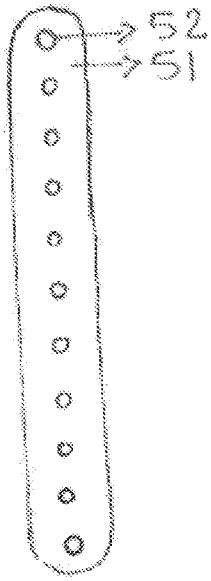
FIG. 27 is a front view of a strap for use with the brassiere shown in FIG. 1.
Figure 28:
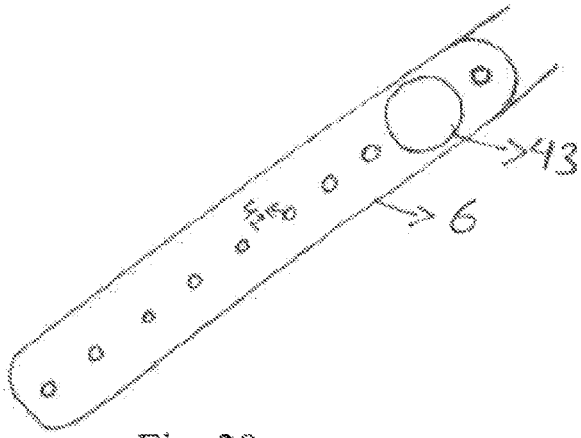
FIG. 28 is an enlarged view of a portion of the strap shown in FIG. 27, the strap secured to an attachment device.
Figure 29:
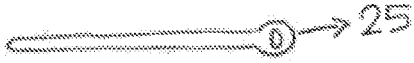
FIG. 29 is front view of an attachment device for securing to the strap and attachment device shown in FIGS. 27 and 28.
Figure 30:
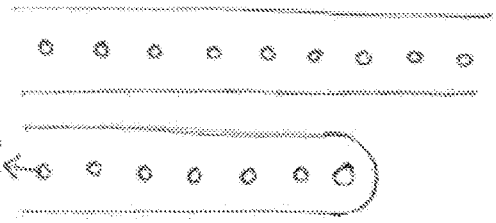
FIG. 30 is an enlarged view of portions of the strap and the attachment device shown in FIG. 27, illustrating engagement features of the strap and the attachment device.
Figure 33:
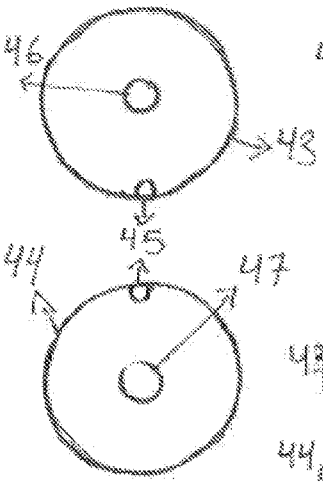
FIG. 33 is an enlarged view of the engagement features of the strap and the attachment device shown in FIG. 27.
Figure 31:
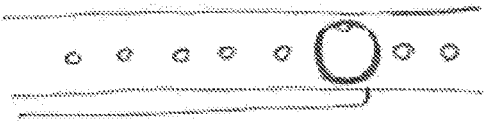
FIG. 31 is an enlarged view of the strap and the attachment device shown in FIG. 27, secured together in a different position.
Figure 32:
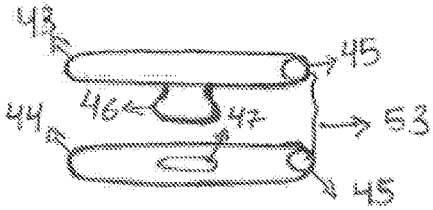
FIG. 32 is a schematic view of engagement features of the strap and the attachment device shown in FIG. 27.

FIG. 27 shows an example embodiment of an additional support strap 51. The strap 51 includes holes 52 that may receive snaps or any suitable attachment mechanisms.

Features described in the proceeding description may be used in combinations other than the combinations explicitly described. Although the teaching of the present application has been described in detail for purpose of illustration, it is understood that such detail is solely for that purpose, and variations can be made therein by those skilled in the art without departing from the general idea of the design. The teaching can also be applied to items that have straps, or wear garments of any sort. It should also be noted that there are many alternative ways of implementing the methods and apparatuses of the teaching of the present application. Whilst endeavoring the foregoing speciation to draw attention to those features of the disclosure believed to be of particular importance it should be understood that the applicant claims protection for any patentable feature or combination of features hereinbefore referred to and/or shown in the drawings whether or not particular emphasis has been placed thereon.

The invention claimed is:

1. A brassiere comprising:

a front piece including a first cup and a second cup, the front piece having a lower edge, the first cup and the second cup each having a bottom located along the lower edge and a top located opposite the lower edge;

a first shoulder strap having a first end and a second end, wherein the first end is connected to the top of the first cup and the second end is connected to the bottom of the first cup or the bottom of the second cup; and a second shoulder strap having a first end and a second end, wherein the first end is connected to the top of the second cup and the second end is connected to the bottom of the second cup or the bottom of the first cup, wherein the brassiere does not include a waistband that wraps around a thoracic region of a wearer, wherein the first shoulder strap and the second shoulder strap provide a downward tension and an upward force on the first cup and the second cup to secure breasts of a wearer in the first cup and the second cup.

2. A brassiere of claim 1, wherein the first end of the first shoulder strap is removably connected to the top of the first cup and the second end is removably connected to the bottom of the first cup or the bottom of the second cup, and wherein the first end of the second shoulder strap is removably connected to the top of the second cup and the second end is removably connected to the bottom of the second cup or the bottom of the first cup.

3. A brassiere of claim 1, further comprising a support strap including a first end removably connected to the first cup and a second end removably connected to the second cup, the support strap including at least one attachment device.

4. A brassiere of claim 3, wherein the front piece and the shoulder straps include a plurality of attachment locations for the support strap.

5. A brassiere of claim 1, wherein the first and second shoulder straps are adjustable.

6. A brassiere of claim 1, further comprising a support strap including a first end connected to one of the front piece, the first shoulder strap, or the second shoulder strap, wherein the support strap is adjustable.

7. A brassiere of claim 1, further comprising a first support strap including a first end connected to one of the front piece, the first shoulder strap, or the second shoulder strap, and a second support strap including a first end configured to removably attach to at least one of the front piece, the first shoulder strap, or the second shoulder strap.

8. A brassiere of claim 1, further comprising a support strap including a first end connected to one of the front piece, the first shoulder strap, or the second shoulder strap, wherein the first cup and the second cup each include a plurality of attachment points for at least one of the first shoulder strap, the second shoulder strap or the support strap, wherein the at least one of the first shoulder strap, the second shoulder strap, or the support strap are configured to attach to the plurality of attachment points.

9. A brassiere of claim 1, wherein the front piece includes an upper edge, wherein the upper edge, the first shoulder strap, and the second shoulder strap form a U-shape.

10. A brassiere of claim 1, further comprising a connector configured to couple the first and second shoulder straps of the brassiere together behind a back of the wearer.

11. A brassiere of claim 1, wherein the front piece includes a bridge extending between the first cup and the second cup, the bridge forms a crisscross pattern.

12. A brassiere of claim 1, wherein the second end of the first shoulder strap is attached to the bottom of the second cup and the second end of the second shoulder strap is attached to the bottom of the first cup, the first shoulder strap and the second shoulder strap form a crisscross pattern behind a back of the wearer.

13. A brassiere of claim 1, wherein the first shoulder strap is removably connected to the bottom of the first cup, and wherein the second shoulder strap is removably connected to the bottom of the second cup.

14. A brassiere of claim 1, wherein the first shoulder strap is removably connected to the bottom of the second cup, and wherein the second shoulder strap is removably connected to the bottom of the first cup.

15. A brassiere of claim 1, further comprising a support strap including a first end removably connected to at least one of the front piece, the first shoulder strap, or the second shoulder strap in a plurality of positions.

16. A method of assembling a brassiere, the method comprising:

attaching a first cup to a second cup to form a front piece, the front piece having a lower edge, the first cup and the second cup each having a bottom located along the lower edge and a top located opposite the lower edge;

connecting a first shoulder strap to the front piece, the first shoulder strap having a first end and a second end, wherein the first end is connected to the top of the first cup, and wherein the second end is connected to the bottom of the first cup or the bottom of the second cup; and connecting a second shoulder strap to the front piece, the second shoulder strap having a first end and a second end, wherein the first end is connected to the top of the second cup, and wherein the second end is connected to the bottom of the second cup or the bottom of the first cup, wherein the brassiere does not include a waistband that wraps around an abdomen of a wearer, wherein the first shoulder strap and the second shoulder strap provide a downward tension and an upward force on the first cup and the second cup to secure breasts of a wearer in the first cup and the second cup.

17. A method of claim 16, wherein connecting the first shoulder strap to the front piece comprises removably connecting the first shoulder strap to the front piece using at least one attachment device on the first shoulder strap.

18. A method of claim 17, wherein connecting the second shoulder strap to the front piece comprises removably connecting the second shoulder strap to the front piece using at least one attachment device on the second shoulder strap.

19. A method of claim 18, further comprising removably connecting a first end of a support strap to at least one of the front piece, the first shoulder strap, or the second shoulder strap using at least one attachment device on the support strap.

20. A brassiere comprising:

a front piece including a first cup and a second cup, the front piece having an upper edge, a lower edge, and an attachment site extending along the lower edge and including a plurality of attachment points, the first cup and the second cup each having a bottom located along the lower edge and a top located opposite the lower edge;

a first shoulder strap having a first end and a second end, wherein the first end is connected to the top of the first cup;

a second shoulder strap having a first end and a second end, wherein the first end is connected to the top of the second cup; and an attachment piece connected to the second end of the first shoulder strap and the second end of the second shoulder strap, the attachment piece configured to extend under the first cup and the second cup of the front piece and attach to the plurality of attachment points on the front piece, wherein the attachment piece, the first shoulder strap, and the second shoulder strap form a U-shaped support and provide a downward tension and an upward force on the first cup and the second cup to secure breasts of a wearer in the first cup and the second cup.

* * * * *